US005974714A

United States Patent [19]

Jones

[11] Patent Number: 5,974,714

[45] Date of Patent: Nov. 2, 1999

[54] PICTURE FRAME BACK ATTACHMENT

[75] Inventor: Joseph W. Jones, Statesville, N.C.

[73] Assignee: Intercraft Company, Statesville, N.C.

[21] Appl. No.: 08/880,264

[22] Filed: Jun. 23, 1997

[51] Int. Cl.[6] ..... G09F 1/12

[52] U.S. Cl. ..... 40/768; 40/790; 40/791

[58] Field of Search ..... 40/740, 768, 777, 40/790, 791, 156

[56] References Cited

U.S. PATENT DOCUMENTS

| | | | |
|---|---|---|---|
| 1,246,095 | 11/1917 | Herrmann . | |
| 1,358,988 | 11/1920 | Rindsberger | 40/790 |
| 1,904,318 | 4/1933 | Lehere . | |
| 2,281,054 | 4/1942 | Smith et al. . | |
| 3,283,431 | 11/1966 | Pearlman | 40/790 |
| 3,665,627 | 5/1972 | MacCluney . | |
| 4,078,326 | 3/1978 | Reim | 40/759 |
| 4,261,124 | 4/1981 | Carter . | |
| 4,364,192 | 12/1982 | Lloyd . | |
| 5,012,601 | 5/1991 | Garland et al. . | |
| 5,058,298 | 10/1991 | Burns . | |
| 5,253,439 | 10/1993 | Shanok et al. | 40/791 X |
| 5,524,370 | 6/1996 | Roy | 40/768 X |
| 5,581,925 | 12/1996 | Snoke et al. | 40/777 X |

FOREIGN PATENT DOCUMENTS

| | | | |
|---|---|---|---|
| 2314030 | 10/1974 | Germany | 40/156 |
| 2327358 | 1/1975 | Germany | 40/156 |

*Primary Examiner*—Brian K. Green
*Attorney, Agent, or Firm*—Foley & Lardner

[57] ABSTRACT

A picture frame is provided including a frame and a backing. The picture frame includes a plurality of side members which are coupled to each other to define a picture receiving region. Each side member has a flange and an interior wall. The flange is located at a front face of the frame and projects into the picture receiving region. The flange has a back surface which is perpendicular to the interior wall. The backing removably retains a picture in the picture receiving region. The picture frame further includes at least one flexible tab extending generally perpendicularly from the interior wall of at least one side member. The tab retains the backing in the frame and is spaced apart from the back surface of the flange by a distance at least equal to a thickness of the backing. When the backing is inserted into the frame, each tab bends towards the flange to allow the backing to pass by.

4 Claims, 5 Drawing Sheets

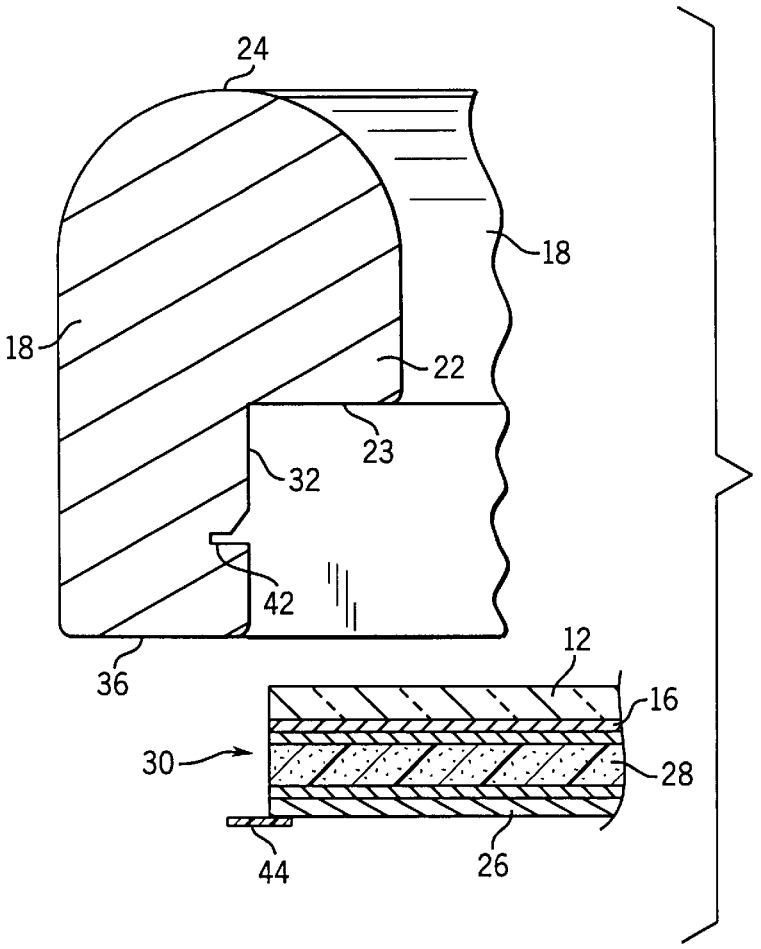
FIG. 11
FIG. 12
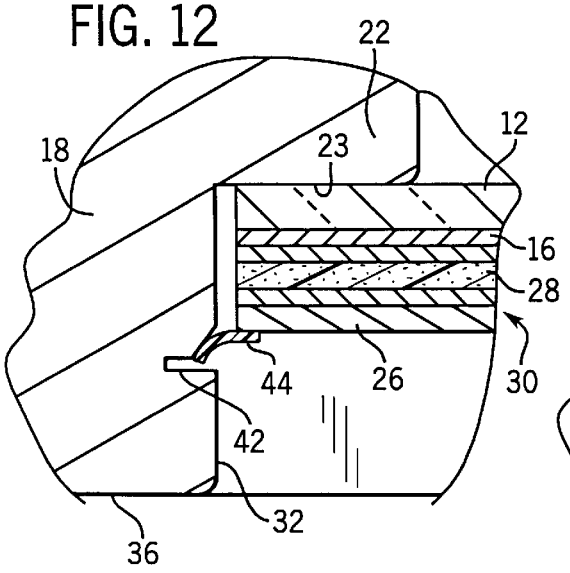
FIG. 13
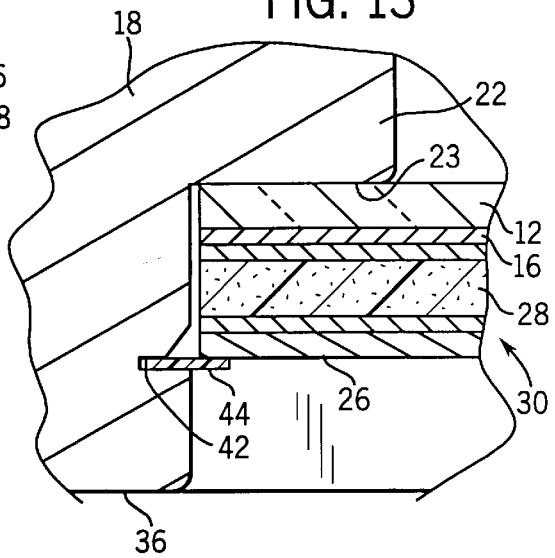

PICTURE FRAME BACK ATTACHMENT

BACKGROUND OF THE INVENTION

The present invention relates generally to picture frames. More specifically, the present invention relates to a structure which enables the contents of a picture frame, including a picture, transparent cover and backing, to be inserted from the back of the picture frame and retained in the frame.

Picture frames provide decorative and protective enclosures for works of art such as photographs and paintings. A conventional picture frame includes a frame defining an interior region which receives and encloses the contents of the frame. The frame may be made of any rigid material including wooden, metal, plastic and ceramic materials. The picture frame also includes a transparent glass or plastic cover for protecting the art work, and filler material for accommodating art work of varying thicknesses. In addition, the picture frame includes a backing for retaining the cover and art work in the frame.

Various mechanisms have been used to secure backings onto picture frames. For example, nails and adhesives provide permanently assembled picture frames. Other less permanent, mechanical fasteners which enable works of art to be removed or replaced include flexible hooks, rotatable retaining clips, and spring loaded clips.

Currently available mechanisms for securing the backings of picture frames have several drawbacks. Nails and adhesives make it difficult to remove or replace art work already framed, since additional nails or adhesives are needed to reattach the backing to the frame. In addition, assembly time is longer for those picture frames with fasteners, such as screws, since they require a tool, and the tool is generally applied to one fastener at a time. In addition to increasing assembly time, mechanical fasteners increase manufacturing costs.

One attempt to eliminate mechanical fasteners from picture frames includes a unitary frame made of vulcanized rubber having a plurality of flaps, one along each back edge of the picture frame. Each flap is separated from the main body of the frame by a slot which enables the flap to be turned back from the frame. While the picture frame eliminates the need for mechanical fasteners, it is cumbersome to use. Each flap must be turned back individually, or all four flaps held simultaneously, in order for a picture to be placed in the frame. In addition, the slots which permit the flaps to be turned back may be subject to tearing.

Another attempt provides for a picture frame having side frame members with a hingedly connected flap. The flaps extend into the picture receiving region of the frame and are biased toward the front of the frame, thereby retaining and urging the cover and backing sheet in the frame. Like the previously mentioned picture frame, this one also requires that the flaps be moved out of the picture receiving region to enable the user to insert a picture.

There is a need for an improved picture frame that does not require any mechanical fasteners and is easy to assemble. There is also a need for a picture frame that is inexpensive to manufacture. Finally, there is a need for a durable picture frame that can accommodate works of art of varying thicknesses.

SUMMARY OF THE INVENTION

The present invention features a picture frame designed to respond to these needs. In particular, the invention provides a picture frame having a flexible tab which projects into a picture receiving region to retain a transparent cover, a picture and a backing in the frame.

Thus, in accordance with one aspect of the invention, a picture frame is provided. The picture frame includes a frame having a plurality of side members which are joined together to define a picture receiving region. Each side member has a flange and an interior wall. The flange is located at a front face of the frame and projects into the picture receiving region. The flange has a back surface which is perpendicular to the interior wall of the side member. The picture frame also includes a transparent cover and a backing which are removably disposed in the picture receiving region. The cover abuts the back surface of the flange. The picture frame further includes at least one flexible tab that extends generally perpendicularly from the interior wall of at least one side member. The tab retains the cover and backing in the frame and is spaced apart from the back surface of the flange by a distance at least equal to a combined thickness of the cover and the backing. When the cover and backing are inserted into the frame, each tab bends towards the flange to allow them to pass by.

In accordance with another aspect of the invention, a picture frame includes a frame having a plurality of side members. Each side member is coupled to adjacent side members to define a picture receiving region and includes a flange and an interior wall. The flange is located at a front face of the frame and projects into the picture receiving region. The flange has a back surface which is perpendicular to the interior wall of the side member. At least one side member has at least one groove formed in the interior wall. The picture frame also includes a transparent cover removably disposed in the picture receiving region and abutting the back surface of the flange. In addition, the picture frame includes a backing having at least one flexible tab engaging the at least one groove of the respective side member to retain the cover and the backing in the frame.

In accordance with a further aspect of the invention, a method is provided for assembling a picture frame. The method includes the steps of providing a frame and inserting a transparent cover and backing from a back face of the frame. The frame includes a plurality of side members and defines a picture receiving region. Each side member has a flange and an interior wall. The flange is located at a front face of the frame and projects into the picture receiving region. The flange has a back surface which is perpendicular to the interior wall. At least one side member of the frame has at least one flexible tab extending generally perpendicularly from the interior wall and into the picture receiving region. When the cover and backing are inserted into the frame, each tab bends towards the flange to allow the cover and backing to move past the tab.

In accordance with still another aspect of the invention, a picture frame includes a frame having a plurality of side members. The side members are coupled together to define a picture receiving region. Each side member include a flange and an interior wall. The flange is located at a front face of the frame and projects into the picture receiving region. The flange includes a back surface which is perpendicular to the interior wall. The picture frame also includes a backing for removably retaining a picture in the picture receiving region and at least one flexible tab extending generally perpendicularly from the interior wall of at least one side member. The tab which retains, the backing in the frame is spaced apart from the back surface of the flange by a distance at least equal to a thickness of the backing. When the backing is inserted into the frame, the tab bends towards the flange.

BRIEF DESCRIPTION OF THE DRAWINGS

The present invention will become more fully understood from the following detailed description, taken in conjunction with the accompanying drawings, wherein like reference numerals refer to like parts, in which:

FIG. 11 is a partially exploded sectional view of the picture frame showing a third embodiment of the invention, including a groove in the frame and a flexible tab mounted to the backing;

FIG. 12 is an enlarged sectional view of the picture frame of FIG. 11 showing the contents inserted into the frame and the filler material compressed; and FIG. 13 is an enlarged sectional view of the picture frame of FIG. 11 showing the contents fully inserted in the frame.

DESCRIPTION OF THE PREFERRED EMBODIMENTS

Figure 1:
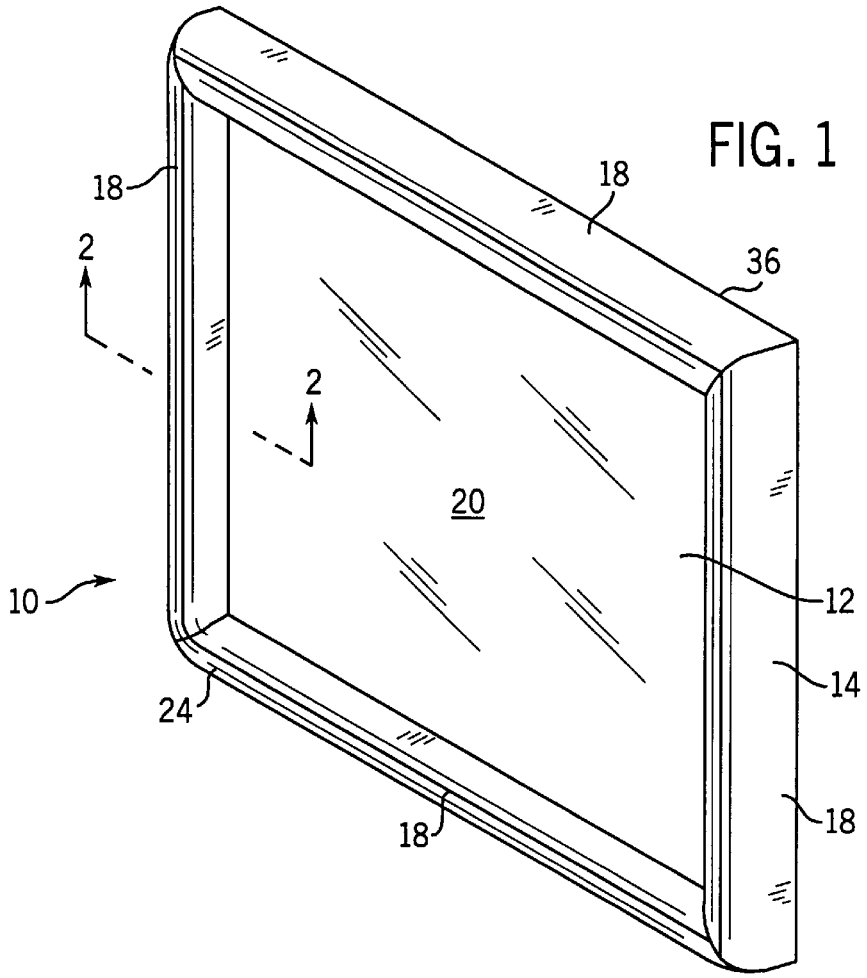
FIG. 1 is a perspective front view of a picture frame.

Turning now to the drawings and referring to FIG. 1, a picture frame 10 is shown. Picture frame 10 includes a transparent cover 12 surrounded by an outer frame 14. Frame 14 is made up of side members 18 which are coupled at their ends to adjacent side members to define a picture receiving region 20. Cover 12 is located in picture receiving region 20. Cover 12 is made of glass or plastic and protects a work of art such as a picture or photograph 16 (FIGS. 2–5).

Side members 18 of frame 14 may be comprised of any rigid material such as wood, medium density fiber board, particle board, plastic, ceramic and metal. As shown generally in FIGS. 2–13, side member 18 includes a flange 22 extending along a front face 24 of frame 14 and into picture receiving region 20. Flange 22 has a back surface 23 which contacts cover 12 to retain cover 12 in frame 14.

In addition to cover 12, picture frame 10 includes a backing 26 and filler material 28 which constitute the contents 30 of picture frame 10. Backing 26 may be made of chipboard, corrugated cardboard, or other paper or wooden material. Backing 26 maintains cover 12, picture 16 and filler material 28 in frame 10 and provides an aesthetic rear enclosure to frame 10. Filler material 28 is disposed between cover 12 and backing 26. In the preferred embodiments of the invention, filler material 28 is made of a compressible material such as foam. In the alternative, other materials such as corrugated cardboard, paper and plastic may be used. Since filler material 28 is compressible, picture frame 10 may accommodate art work of varying thicknesses.

Figure 2:
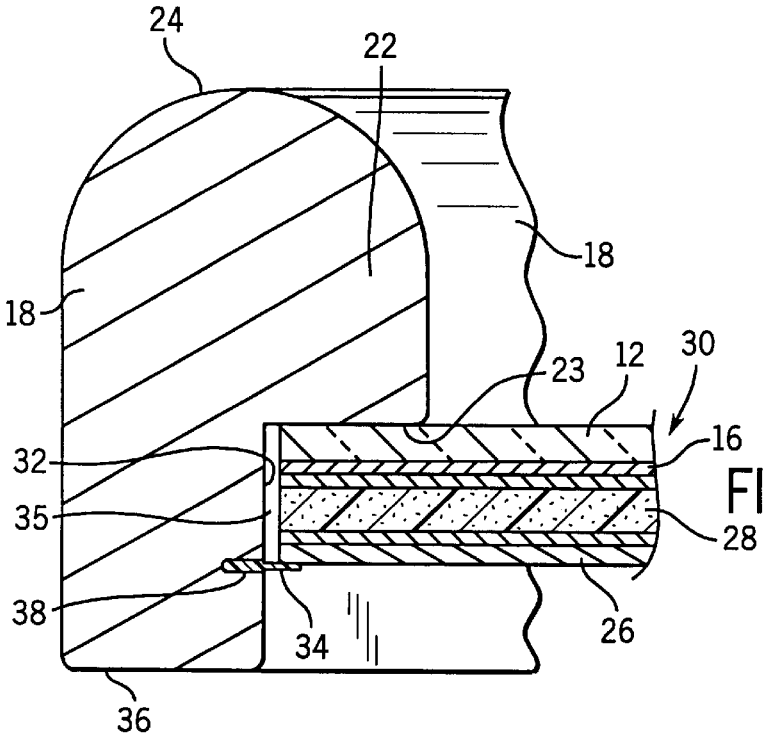
FIG. 2 is a sectional view of the picture frame taken generally along line 2—2 of FIG. 1 and showing a first embodiment of the invention including a flexible tab and contents of the frame, such as a cover, a picture, filler material and a backing.

FIGS. 2–6 illustrate a preferred embodiment of the invention. Side member 18 has an interior wall 32 and a flexible tab 34 extending generally perpendicular to interior wall 32 and projecting into picture receiving region 20 of frame 14. Tab 34 spans the length of interior wall 32 of side member 18. As shown in FIG. 2, flexible tab 34 is located towards a back face 36 of frame 14 and is separated from flange 22 by a distance approximately equal to the combined thickness of cover 12, filler material 28 and backing 26.

Tab 34 is made of a flexible material such as polyvinyl chloride or polypropylene. Tab 34 is preferably integrally formed with side member 18, such as by a coextrusion process. In the alternative, tab 34 may be press fit into a groove 38 formed in interior wall 32. Press fitting tab 34 into groove 38 enables side member 18 to be made of any rigid material. However, manufacture of picture frame 10 would require an additional step to insert tab 34 into groove 38 of side member 18. Co-extrusion produces side member 18 with tab 34 already in place. In order to co-extrude side member 18 with tab 34, side member 18 must be comprised of a plastic material such as styrene or polyvinyl chloride.

Figure 3:
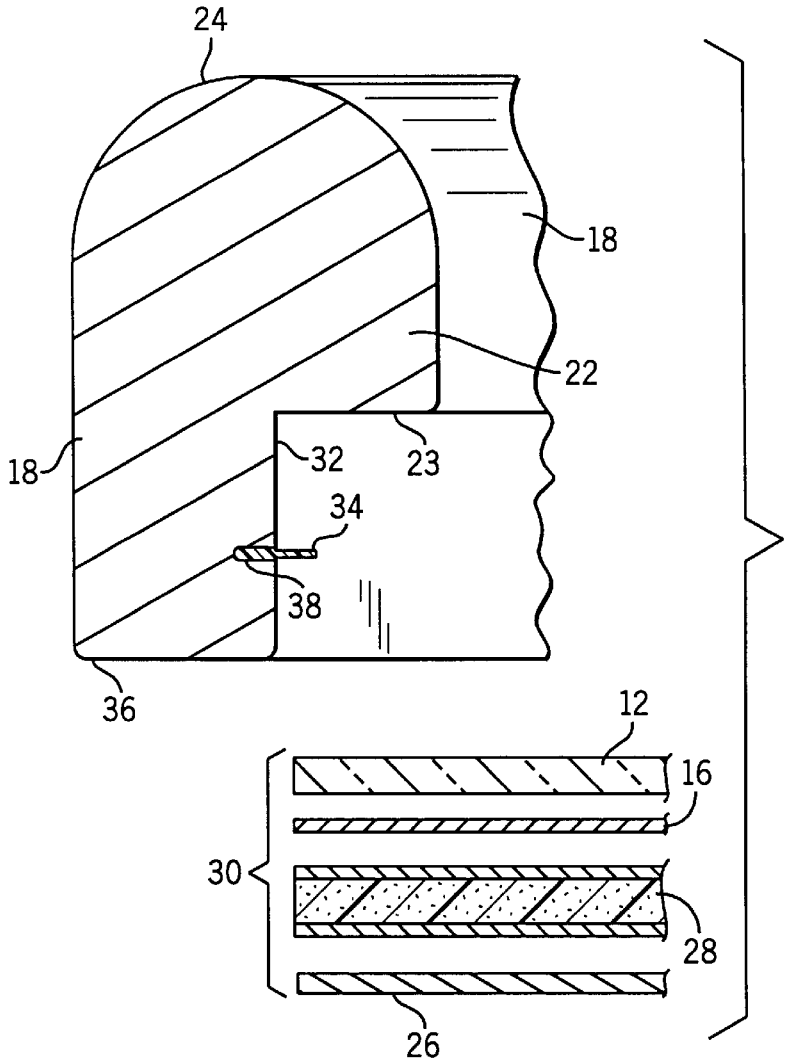
FIG. 3 is an exploded view of the picture frame shown in FIG. 2.
Figure 4:
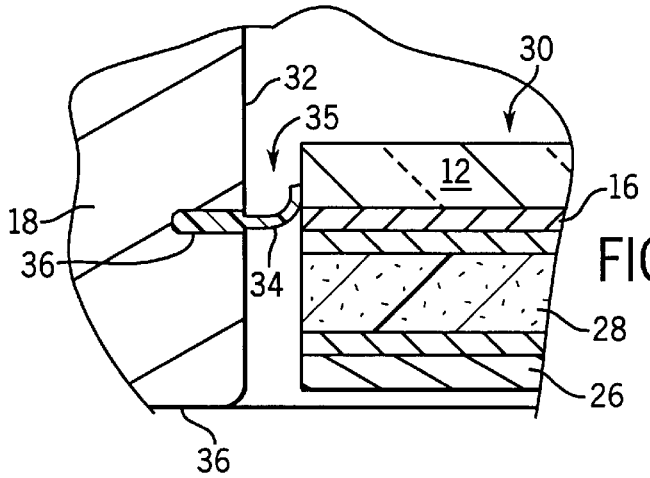
FIG. 4 is a sectional view of the picture frame of FIG. 2 showing the contents inserted into the frame and past the flexible tab.
Figure 5:
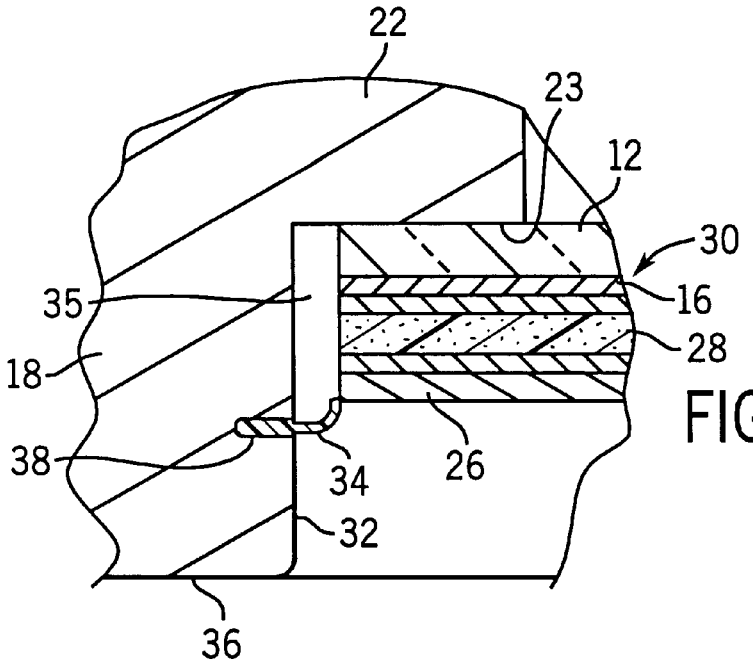
FIG. 5 is a sectional view of the picture frame of FIG. 2 showing the contents fully inserted into the frame and the filler material compressed.
Figure 6:
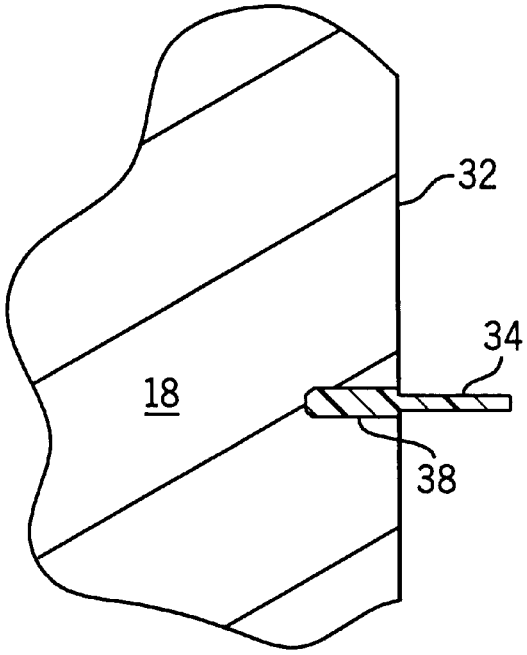
FIG. 6 is an enlarged view of the flexible tab of the picture frame shown in FIG. 2.
Figure 7:
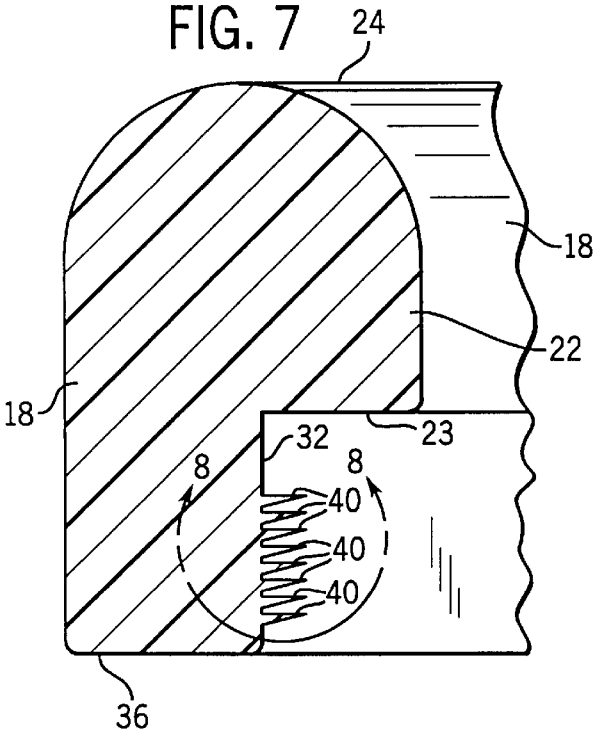
FIG. 7 is a sectional view of the picture frame showing a second embodiment of the invention, including a series of flexible tabs with the contents removed from the frame.
Figure 8:
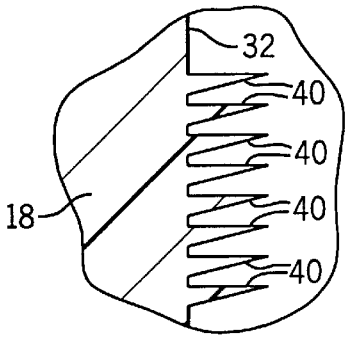
FIG. 8 is an enlarged view of the series of flexible tabs taken generally along line 8—8 of FIG. 7.

Tabs 34 of side members 18 enable picture frame 10 to be constructed quickly and without the use of tools or mechanical fasteners. Assembly of picture frame 10 is illustrated in FIGS. 3–5. A picture 20 is first placed between cover 12 and filler material 28, and backing 26 is stacked behind filler material 28 (FIG. 3). The contents 30 are then inserted into picture receiving region 20 from back face 36 of frame 14. Contents 30 have dimensions smaller than that of picture receiving region 20. Thus, there is a gap 35 between contents 30 and interior wall 32 of side member 18. As contents 30 are inserted into frame 14, tabs 34 of side members 18 bend towards flange 22 and into gap 35, allowing contents 30 to slide past (FIG. 4). Contents 30 are inserted into picture receiving region 20 so that cover 12 is pressed against back surface 23 of flanges 22 and filler material 28 is compacted, enabling tab 34 to move past backing 26 and out of gap 35 (FIG. 5). Once tab 34 has returned to its original position, contents 30 may be released, allowing filler material 28 to expand to its normal position. Tab 34 is made of a flexible material that is strong enough to retain contents 30 in picture frame 10. To remove or replace picture 20, contents 30 are pushed in the opposite direction from front face 24 of picture frame 10 towards back face 36. Tabs 34 bend towards back face 36, allowing contents 30 to be removed from picture frame 10.

Figure 9:
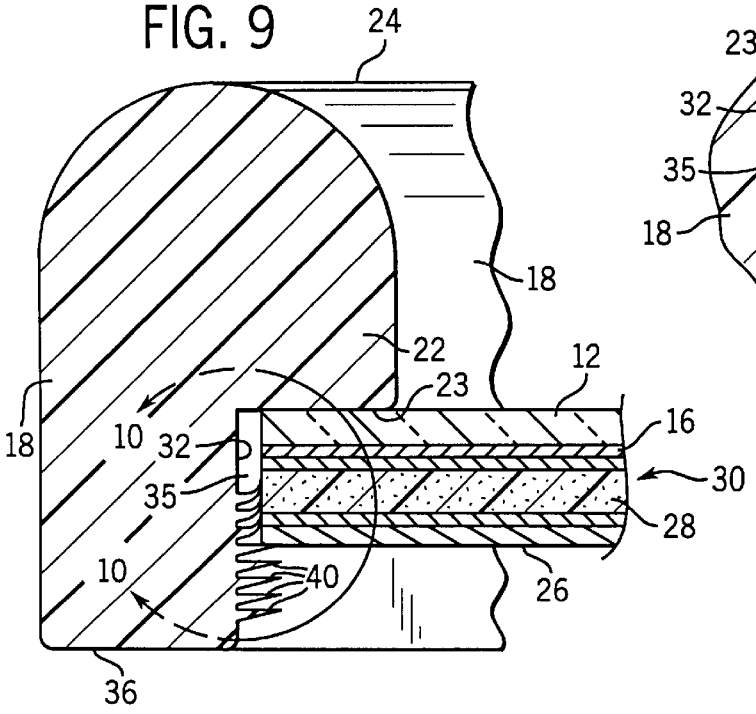
FIG. 9 is a sectional view of the picture frame shown in FIG. 7 showing the contents fully inserted into the frame.
Figure 10:
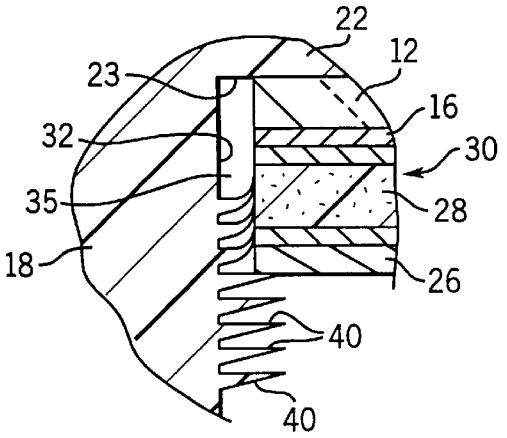
FIG. 10 is an enlarged view of the picture frame taken generally along line 10—10 of FIG. 9.

In FIGS. 7–10 a second embodiment of the invention is shown. Side member 18 is provided with a series of flexible tabs 40. Tabs 40 are spaced in parallel along the width of interior wall 22 of side member 18. Like tabs 34 of the first embodiment of the invention, each series of tabs 40 is preferably co-extruded with side member 18 and extends the length of interior wall 22. Contents 30 may be inserted into picture frame 10 in the same manner as discussed above. As shown in FIGS. 9 and 10, tabs 40 are arranged in a series spanning a portion of the width of interior wall 22 and depending on the thickness of picture 20, several tabs 40 toward front face 24 may be bent into gap 35 while contents 30 are retained in picture frame 10.

FIGS. 11–13 illustrate a third embodiment of the invention wherein side member 18 has a groove 42 formed therein. Backing 26 includes a tab 44 which projects outward from backing 26 and engages groove 42 of respective side member 18 to retain contents in the picture frame 10. Tab 44 may be integrally formed with backing 26 or may be mounted to backing 26 by an adhesive or other fastener. When contents 30 are inserted into picture frame 10, filler material 28 is compressed until tab 44 of backing 26 engages groove 42 of corresponding side member 18. Once each tab 44 has engaged with corresponding groove 42, contents 30 are secured in picture frame 10 and may be released, allowing filler material 28 to expand to its normal state.

While the embodiments illustrated in the Figures and described above are presently preferred, it should be understood that these elements are offered by way of example only and may be adapted to various other structures. For example, while tab 34 and series of tabs 40 of the first and second embodiments of the invention, respectively, extend along the entire length of interior wall 22 of side member 18, tab 34 and series of tabs 40 could be shorter or intermittently spaced along side member 18. In addition, the presently preferred embodiments include tabs 34 and 40 for every side member 18 of frame 14 and tab 44 for every edge of backing 26. However, tabs 34 and 40 may be present on only one set of opposing side members 18 of frame 14, and tabs 44 on only one set of opposing edges cf backing 26. Furthermore, in certain circumstances as with matted posters, it may not be necessary to have cover 12 or compressible filler material 28 in picture frame 10. These and other modifications may be made in the design and arrangement of other elements without departing from the scope of the invention as expressed in the appended claims.

What is claimed is:

1. A picture frame consisting essentially of:

a frame including a plurality of side members, each side member being coupled to adjacent side members to define a picture receiving region, each side member including a flange and an interior wall, the flange being located at a front face of the frame and projecting into the picture receiving region, the flange having a back surface perpendicular to the interior wall, at least one pair of opposing side members having a groove formed in the interior walls thereof;

a transparent cover having a first thickness removably disposed in the picture receiving region and abutting the back surface of the flange; and a backing having a second thickness and a pair of flexible, elastomeric tabs for each pair of opposing side members having grooves formed in the interior walls thereof, whereby the backing is attached to the frame exclusively by the elastomeric, flexible tabs.

2. The picture frame of claim 1, wherein the grooves are spaced apart from the back surface of the flange of the respective opposing side members by a distance equal to or greater than the sum of the first and second thicknesses.

3. The picture frame of claim 1, wherein the backing includes a compressible filler material.

4. The picture frame of claim 3, wherein the compressible filler material comprises foam.

* * * * *